US008479465B2

(12) United States Patent
Sondermann

(10) Patent No.: US 8,479,465 B2
(45) Date of Patent: Jul. 9, 2013

(54) SKIRTING BOARD HAVING A RAIL

(75) Inventor: Frank Sondermann, Drolshagen (DE)

(73) Assignee: Kueberit Profile Systems GmbH & Co., KG, Luedenscheid (DE)

( * ) Notice: Subject to any disclaimer, the term of this patent is extended or adjusted under 35 U.S.C. 154(b) by 168 days.

(21) Appl. No.: 13/004,206

(22) Filed: Jan. 11, 2011

(65) Prior Publication Data

US 2011/0167745 A1 Jul. 14, 2011

(30) Foreign Application Priority Data

Jan. 14, 2010 (DE) ..... 20 2010 000 996 U

(51) Int. Cl.
*E04B 2/00* (2006.01)

(52) U.S. Cl.
USPC ..... 52/287.1; 52/288.1

(58) Field of Classification Search
USPC ..... 52/287.1, 288.1, 254
See application file for complete search history.

(56) References Cited

U.S. PATENT DOCUMENTS

| | | | | |
|---|---|---|---|---|
| 3,707,061 | A * | 12/1972 | Collette et al. | 52/288.1 |
| 3,821,688 | A * | 6/1974 | Larsile | 439/209 |
| 5,598,681 | A * | 2/1997 | DiGianni | 52/717.05 |
| 6,315,489 | B1 * | 11/2001 | Watanabe | 403/381 |
| 6,469,250 | B1 * | 10/2002 | Decore et al. | 174/95 |
| 6,505,448 | B2 * | 1/2003 | Ito | 52/474 |
| 2004/0168384 | A1 * | 9/2004 | Wesolowska | 52/287.1 |

FOREIGN PATENT DOCUMENTS

| | | |
|---|---|---|
| DE | 1 763 163 | 3/1958 |
| DE | 29 12 030 | 10/1980 |
| DE | 20 2007 012 734 U1 | 12/2007 |
| FR | 2822181 A1 | 9/2002 |
| JP | 2008215005 | 9/2008 |

* cited by examiner

*Primary Examiner* — Basil Katcheves
(74) *Attorney, Agent, or Firm* — Epstein Drangel LLP; Robert L. Epstein

(57) ABSTRACT

A skirting has a profiled rail which forms an accommodating area for a covering. The accommodating area has an opening, through which a visible side of a covering can be seen. The profiled rail has stops on both sides of the opening which are drawn towards said opening. In this case, the opening is dimensioned so as to be smaller than the width of the covering. The covering is pressed against the stops by a spring. In order that it is also possible to use flexible coverings, such as those made of textile materials, for example, at least one plate is provided between the spring and the covering. This plate keeps the covering in a flat configuration.

8 Claims, 3 Drawing Sheets

SKIRTING BOARD HAVING A RAIL

CROSS-REFERENCE TO RELATED APPLICATIONS

This application claims priority to German Patent Application No DE 20 2010 000 996.0, filed Jan. 14, 2010, which is incorporated herein by reference in its entirety

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The invention relates to a skirting having a profiled rail.

2. Description of Prior Art Including Information Disclosed Under 37 CFR 1.97 and 1.98

DE 1 763 163 U1 discloses a skirting which has a profiled rail made from plastic. This profiled rail is substantially U-shaped, with an accommodating area for a covering being formed between the limbs of the U profile. In general, a piece of any covering that also forms the adjoining floor covering is used here, with the result that the skirting and the floor covering give the same visual impression.

DE 29 12 030 C2 discloses a skirting of the generic type in which a decorative strip can be clipped in. The decorative strip has stops which interact with a recess in the skirting. In order to hold the decorative strip on the skirting, a spring is provided on the skirting, said spring pressing against the decorative strip from behind.

BRIEF SUMMARY OF THE INVENTION

The invention is based on the object of providing a skirting of the type mentioned at the outset which is characterized by more universal applicability.

This object is achieved according to the invention by the following features.

In known types of skirting, the covering is adhesively bonded directly to a vertical web of the profiled rail forming the skirting. The covering is therefore spread out to a greater or lesser extent in the skirting, depending on the thickness of the covering, which impairs the visual impression of the skirting. It was therefore necessary to produce different types of skirting for different thicknesses of covering, which increased the degree of complexity involved in terms of production and storage and the focus was primarily on the application in connection with thin coverings. In order to be able to use the skirting more universally, it is necessary to match the thickness to the respective thickness of the covering. This is implemented in that the profiled rail of the skirting has stops against which the covering is pressed. The force of pressure required for this is applied by at least one spring. This ensures that that side of the covering which is visible through an opening in the profiled rail assumes the same position. In the case of thick coverings, the spring is compressed to a correspondingly greater extent and, in the case of thin coverings, to a correspondingly lesser extent, wherein this compensation takes place within the non-visible accommodating area within the profiled rail. It is thus possible for one and the same skirting to be used for floor coverings of different thicknesses without the visual impression of the skirting overall being adversely affected. It is therefore possible, for example, for the upper termination of the skirting to be shaped in such a way that it is aligned with the stop. If the stop is formed so as to be correspondingly thin, a virtually aligned orientation with respect to the covering also results. This visually desirable alignment is in this case independent of the thickness of the covering since the visible side of the covering always bears against the stop.

In particular when using deformable coverings such as carpets, for example, the spring can result in an undesired bulbous deformation of the covering if the spring acts at least also in the central region of the covering, where the stops are not pressing in the opposite direction. On the other hand, the covering is not positioned flat in the accommodating area either if pressure is applied with the at least one spring exclusively to the peripheral region of said accommodating area. In order to solve this problem, the at least one spring is provided on at least one plate which is aligned with the covering. This ensures that the covering is exclusively pressed flat, which prevents any bulbous deformation of the covering irrespective of the stability thereof.

In order to achieve a design of the skirting which is as simple as possible and therefore as cost-effective as possible, it is advantageous if the at least one spring is integral with the profiled rail. In this case, the spring is produced together with the profiled rail in one working step, and it is also not necessary for the spring to be fitted in any way within the skirting.

As an alternative, it is favourable if the at least one spring is provided as a separate component part between the profiled rail and the covering. It is then possible, without any problems, for the spring to be manufactured from a different material from the skirting. This is advantageous in particular in those cases where the skirting is manufactured from materials with poor elasticity such as aluminium, for example. A spring manufactured from aluminium would break relatively quickly owing to material fatigue. The thickness matching can be performed within a relatively wide range by virtue of springs being used for particularly thick coverings which have a shorter spring extension than those used for very thin coverings. In this case, the profiled rail for the skirting itself remains unchanged.

In order to simplify the production of the entire skirting, it is advantageous if the at least one spring is integral with the plate. Any fitting steps for fastening the spring to the plate are therefore no longer required.

In order to make the production of the at least one spring as cost-effective as possible, it is advantageous if the spring is cut free from or bent out of the profiled rail or the plate. In this case it is insignificant whether this shape is achieved by cutting or milling and subsequent bending or by means of injection moulding, for example. It is merely important that the spring extends outside the plane extent of any component part on which it is held and is capable of moving relative to this component part. The desired spring effect can thus be achieved.

Finally, it is favourable if the at least one spring consists of an elastic metal, a polymer and/or a polymer foam. In particular iron alloys such as spring steel or the like have proven to be successful when used as the elastic metal. Possible polymers are in particular polyethylene, polyurethane or similar substances. As an alternative, the spring can also be realized by a polymer foam which can be applied to the profiled rail or the plate over the entire area, for example. This polymer foam is in this case preferably open-celled in order to realize as great a spring excursion as possible.

Further advantages and features of the present invention are presented in the following detailed description with reference to the accompanying figure which contains an exemplary embodiment of the present invention. It should be understood, however, that the drawing serves merely for the purpose of illustrating the invention and does not restrict the scope of protection of the invention.

BRIEF DESCRIPTION OF THE SEVERAL VIEWS OF DRAWINGS

To these and to such other objects that may hereinafter appears, the present invention relates to a skirting as described in detail in the following specification and recited in the annexed claims, taken together with the accompanying drawing in which:

DETAILED DESCRIPTION OF THE INVENTION

Figure 1:
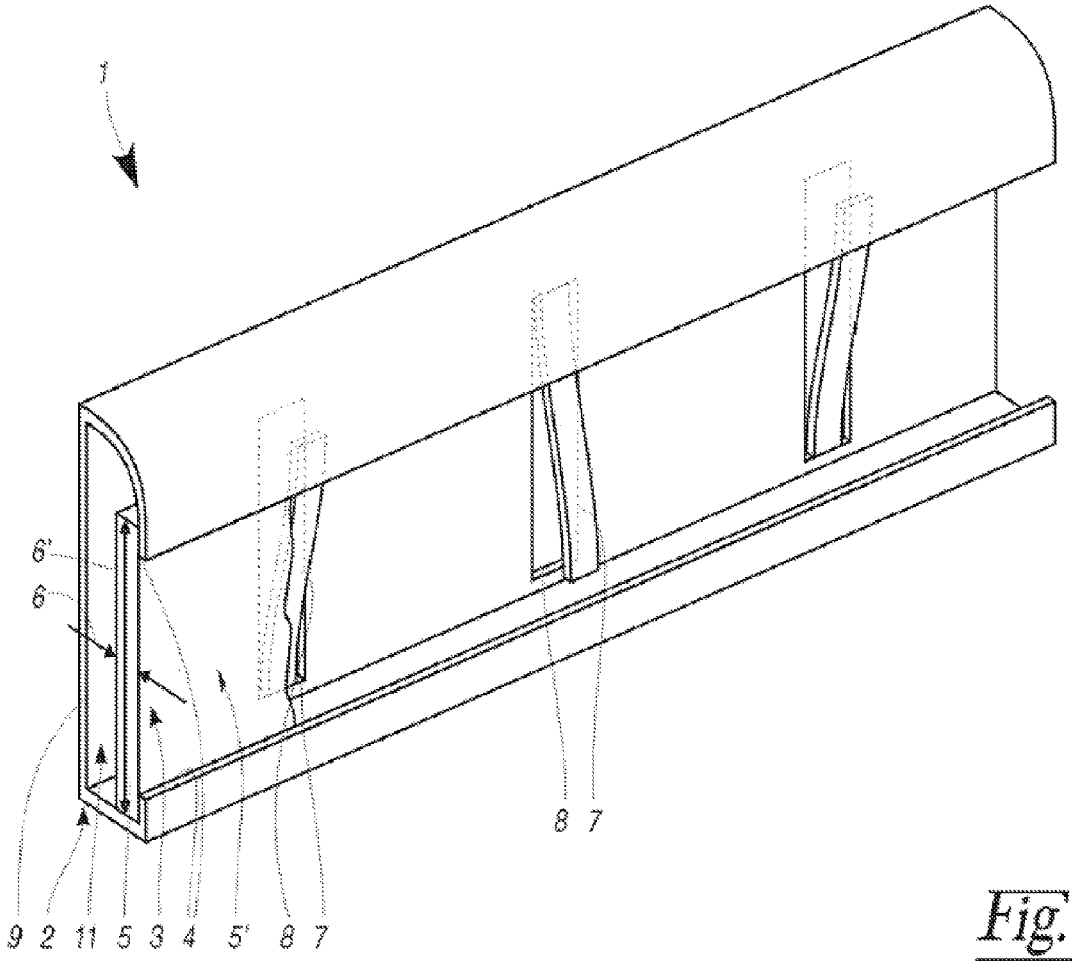
FIG. 1 shows a three-dimensional, partially sectioned illustration of a first embodiment of a skirting.

FIG. 1 shows a three-dimensional illustration of a first embodiment of a skirting 1. This skirting 1 has a profiled rail 2, which has an accommodating area 11 for a covering 5 and an opening 3. The opening 3 is dimensioned so as to be smaller than a width 6' of the covering 5. The profiled rail 2 is equipped with stops 4 on both sides of the opening 3, and the covering 5 bears against said stops. The opening 3 may be wide enough to make it possible to fit the covering 5 through the opening 3. In this case, the covering 5 is tilted relative to the profiled rail 2 and pushed behind the upper stop. Then, the covering 5 is pressed in with its lower edge and pushed behind the lower stop 4.

In order to ensure that the covering 5 bears cleanly against the stops 4 irrespective of the thickness 6 of said covering, the skirting 1 has a plurality of springs 7. These springs 7 exert a force on the covering 5 which is directed towards the stop 4. The springs 7 are in this case cut free from the rear wall 9 of the profiled rail 2 by cuts 8. The springs 7 are thus freely movable and are bent out of the plane extent of the rear wall 9 in such a way that they exert a corresponding prestress on the covering 5 even in the case of thin coverings 5. In order to prevent the covering 5 from tipping about a longitudinal axis, the springs 7 are arranged in such a way that they act alternately, firstly in the region of the upper stop 4 and secondly in the region of the lower stop 4.

Figure 2:
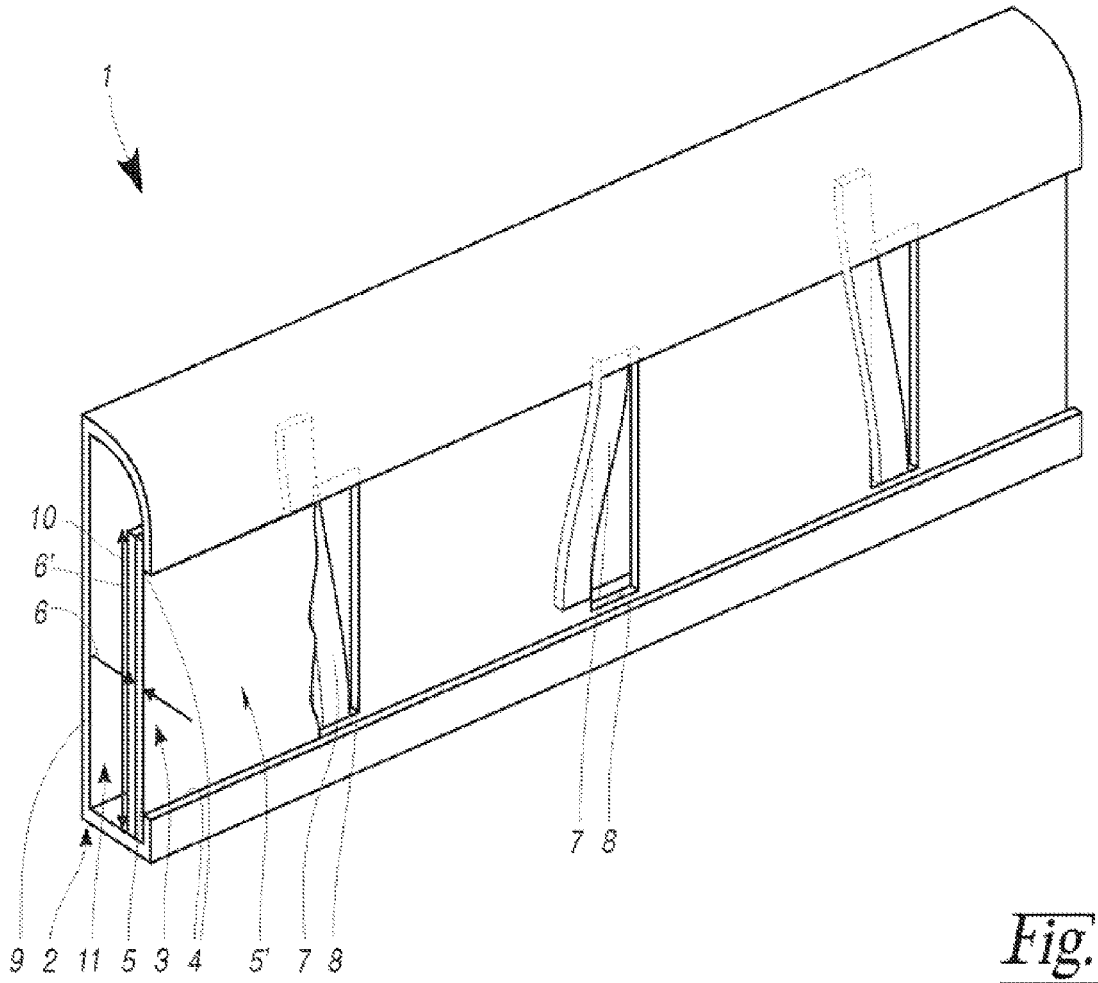
FIG. 2 shows a second embodiment of the skirting.

FIG. 2 shows an alternative embodiment of the skirting 1 shown in FIG. 1, wherein the same reference symbols denote the same parts. The text which follows merely provides details of the differences in relation to the embodiment shown in FIG. 1.

In this embodiment, the springs 7 are not integral with the rear wall 9 of the profiled rail 2 but are integral with an additional plate 10, which is provided as a separate part in the accommodating area 11 for the covering 5. The plate 10 presses flat against the covering 5 and stabilizes said covering. This measure is important for preventing the covering 5 from bending between the stops 4, in particular in the case of highly flexible coverings 5, such as those made from a textile material, for example. The springs 7 are cut free from the plate 10 by corresponding cuts 8 in the same way as in the embodiment shown in FIG. 1.

Figure 3:
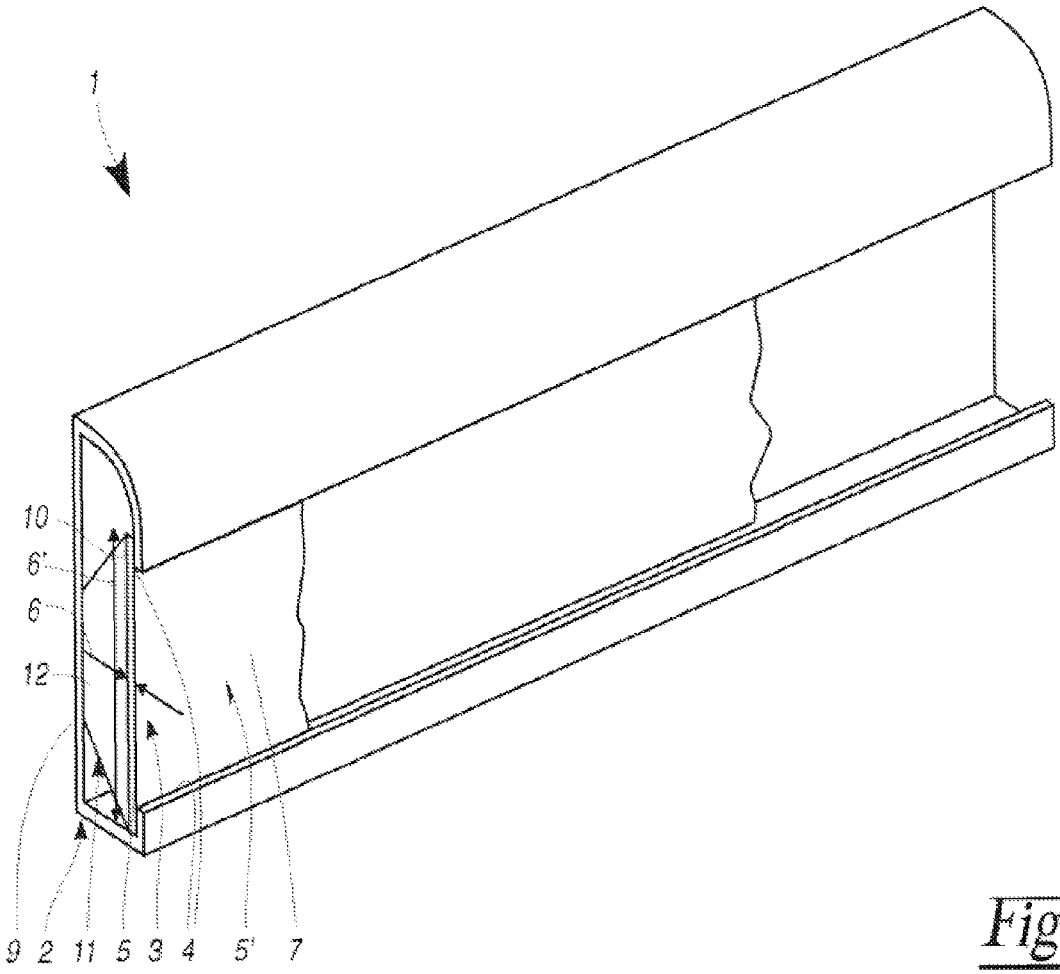
FIG. 3 shows a third embodiment of a skirting.

Finally, FIG. 3 shows a further alternative embodiment of a skirting 1 as shown in FIG. 1, wherein, in turn, the same reference symbols denote the same parts. The text which follows merely provides details of the differences in relation to the embodiment shown in FIG. 1.

In this embodiment, the spring 7 is formed by a polymer foam 12, which can be adhesively bonded to the rear wall 9 or to the covering 5, for example. This adhesive joint is not absolutely necessary, however. The polymer foam 12 may be fastened to the rear wall 9 of the profiled rail 2 in order to be able to replace the covering 5 easily. In order to facilitate fitting of the covering 5, the polymer foam 12 is formed so as to taper at an angle at the rear. The covering 5 can thus be tilted more easily.

Since some exemplary embodiments of the present invention are not shown or described, it must be understood that a multiplicity of changes and modifications of this exemplary embodiment described are possible, without departing from the essential idea and scope of protection of the invention defined by the claims.

LIST OF REFERENCE SYMBOLS

1 skirting
2 profiled rail
3 opening
4 stop
5 covering
5' visible side
6 thickness
6' width
7 spring
8 cut
9 rear wall
10 plate
11 accommodating area
12 polymer foam

I claim:

1. A skirting board having a profiled rail comprising:

a rear wall and an accommodating area located in front of said rear wall, said accommodating area being adapted to accommodate a covering having a visible side and a width, said accommodating area having at least one opening through which said visible side of the covering is visible when the covering is accommodated within said accommodating area;

two opposing sides defining said at least one opening, said two opposing sides being provided with stops dimensioned so that said at least one opening is smaller than said width of said covering;

at least one plate is provided in said accommodating area, said covering being provided on said at least one plate, and at least one spring abutting said rear wall, and said at least one plate, said at least one spring being adapted to press said covering in abutment with said stops, away from said rear wall.

2. A skirting board according to claim 1, wherein the at least one spring is integral with the profiled rail.

3. A skirting board according to claim 2, wherein the at least one spring is cut free from or bent out of the profiled rail.

4. A skirting board according to claim 1, wherein the at least one spring is provided between the profiled rail and the at least one plate.

5. A skirting board according to claim 4, wherein the at least one spring is integral with the at least one plate.

6. A skirting board according to claim 5, wherein the at least one spring is cut free from the at least one plate.

7. A skirting board according to claim 5, wherein the at least one spring is bent out of the at least one plate.

8. A skirting board according to claim 1, wherein the at least one spring includes at least one of an elastic metal, a polymer and a polymer foam.

* * * * *